United States Patent [19]

Abler

[11] 4,381,586

[45] May 3, 1983

[54] WIDTH CONTROL AND ALIGNMENT MEANS FOR CONTINUOUS EXTENSIBLE WEB

[75] Inventor: Norman C. Abler, Menomonee Falls, Wis.

[73] Assignee: Borg Textile Corporation, Chicago, Ill.

[21] Appl. No.: 179,427

[22] Filed: Aug. 19, 1980

Related U.S. Application Data

[63] Continuation of Ser. No. 927,006, Jul. 24, 1978, abandoned, which is a continuation-in-part of Ser. No. 719,017, Aug. 30, 1976, Pat. No. 4,102,023.

[51] Int. Cl.[3] ..... D06C 23/02

[52] U.S. Cl. ..... 26/2 E; 26/16; 26/74; 26/51; 226/16; 226/42

[58] Field of Search ..... 26/51, 71, 74, 75, 76, 26/77, 51.5, 106, 2 E, 16; 226/10, 16, 24, 40, 41, 42

[56] References Cited

U.S. PATENT DOCUMENTS

| | | | |
|---|---|---|---|
| 2,947,057 | 8/1960 | Meagher, Jr. et al. | 26/78 |
| 3,124,429 | 3/1964 | Alexeff et al. | 26/106 X |
| 3,234,662 | 2/1966 | Alexeff et al. | 26/106 X |
| 3,413,695 | 12/1968 | Hergert | 26/2 E |
| 3,465,397 | 9/1969 | Hergert | 26/2 E |
| 3,570,080 | 3/1971 | Holm | 226/42 X |
| 3,785,016 | 1/1974 | Hergert | 26/2 E |
| 3,838,481 | 10/1974 | Kuroda | 26/77 |
| 3,997,947 | 12/1976 | Hergert | 26/2 E |
| 4,017,722 | 4/1977 | Swanson | 26/51.5 X |
| 4,102,023 | 7/1978 | Abler | 26/16 |

OTHER PUBLICATIONS

*Fife Automatic Guiding Systems,* 1005 R976, Fife Corporation, Oklahoma City, Oklahoma, 15 pages.

*Fife Industrial Process Controls,* 1008 R1074, Fife Corporation, Oklahoma City, Oklahoma, 8 pages.

*Primary Examiner*—Robert Mackey

*Attorney, Agent, or Firm*—Hill, Van Santen, Steadman, Chiara & Simpson

[57] ABSTRACT

A control system is provided for maintaining a constant predetermined transverse width in a continuous elastic or extensible web while the web is traveling longitudinally and while simultaneously transversely aligning the longitudinally moving web in register with a transversely extending work station which transversely extends across the web path at a preset location. The invention further provides contoured electrifier apparatus which is adapted for use in the polishing of three dimensional deep pile surface contoured fabrics and the like. In addition, the invention provides ways of adapting the control system for use with a plurality of transversely extending processing units, each one of which can have transversely varying process conditions such as required in a contour shearing device or contoured electrifier.

16 Claims, 17 Drawing Figures

WIDTH CONTROL AND ALIGNMENT MEANS FOR CONTINUOUS EXTENSIBLE WEB

RELATED APPLICATION

This is a division of application Ser. No. 927,006, filed July 24, 1978. This application is a continuation-in-part of my earlier filed U.S. patent application Ser. No. 719,017 filed Aug. 30, 1976 now U.S. Pat. No. 4,102,023 granted July 25, 1978. The disclosure and contents of which are entirely incorporated by reference herein.

BACKGROUND OF THE INVENTION

I have previously invented a contour shear rest for use in a plane shearing machine to simulate, in a three dimensional deep-pile fabric the effect obtained by sewing together small animal pelts, such as mink. The shear rest there provided has a contour surface made up of elements forming a mirror image of the desired contour. The contour surface is formed so that the length of the travel path of the fabric drawn across its face is uniform. See my co-pending U.S. application Ser. No. 719,017 which has now been assigned U.S. Pat. No. 4,102,023.

In endeavouring to utilize the contour shear rest of such invention for the commercial production of contour sheared deep pile fabrics, it was discovered that for purposes of continuously maintaining a precise interrelationship between a patterned web of high pile fabric and a contour shear device incorporating such contour shear bar, it was desirable to continuously make adjustments in the transverse alignment of the web relative to the contour shear work station. It was also desirable, during operation, to maintain a continuously variable but optimized longitudinal tension upon the web because thereby the transverse width of the patterned web could be influenced and hence bring and maintain the web into a desired exact transverse registration with the contours of the contour shear device. Inherent structural variations seemingly tend to occur in a continuous web of pile fabric so that it does not appear to be feasible to merely initially at a start up adjust the transverse alignment and longitudinal tension of a continuous web of pile fabric relative to a transversely extending work station since variations can develop during machine operation after the web has advanced even relatively short distances. Consequently, for purposes of plant operation, particularly an automated plant operation, it is desirable to have a control system for transversely aligning and continuously, variably longitudinally tensioning a continuous web relative to a transversely extending work station. So far as I am aware, this type of control problem has never previously been met or solved through the provision of an appropriate control system.

In addition, it has also been determined that when employing a contour shear device of the character above described, it is desirable to employ a contour electrifier for subsequent polishing operations. As those skilled in the art appreciate, a machine known as an electrifier is used in the processing of pile fabrics, fur, and similar yardage to place the fur or pile in a desired or proper finished condition. Generally speaking, the function of an electrifier is to brush, comb, beat, polish, and/or iron which is accomplished by the application to the pile or fur of a rapidly rotating heated roll which has a grooved surface. Work pieces are fed continuously to the roll with the pile or fur faced toward the roll and an apron of canvas or other suitable web support means which will insure the desired exposure of the pile to the electrifier cylinder is so mounted with respect to the roll that the fabric is fed between the apron or support means and the roll. Typically, the temperature of the surface of an electrifier roll is critically controlled.

In processing by an electrifier, a fabric which has been contour sheared by a contour shear device such as described in my above referenced invention, it has been found that undesirable variations in the product pile finished characteristics can be obtained owing to the inability of prior art electrifiers to conform in their surface application characteristics to pile contours. So far as I am aware, no one has heretofore succeeded in providing electrifiers whose working surfaces are adapted to conform to contours previously formed in a pile or fur work piece.

Further, it has now been determined that, in the processing of, for example, contour sheared high pile sliver knit fabrics, it would be desirable to use a train of contour processing units in some desired processing sequence with the individual processing units being either a contour shear device or a contoured electrifier device. Since problems of alignment, tensioning, and registration of web relative to contour processing unit can arise at each unit in such a train, it is desirable to have a system for controlling a continuously moving web being processed by a train of such contour processing units which permits the web to be aligned for all units with a minimum of control hardware. If, for example, a single separate control unit of the type necessary for achieving alignment, registration and tensioning, as desired, were necessary at each individual contour processing unit, manufacturing costs would apparently be substantially and undesirably increased. Hence, there is a need for using a single control system to simultaneously and effectively control a web during its passage past a plurality of contour processing units.

BRIEF SUMMARY OF THE INVENTION

The present invention provides apparatus and methods for overcoming the problems above described in utilizing contour shearing apparatus.

Thus, in one aspect, the present invention relates to a control system for web alignment, registration, and longitudinal tensioning along a web path relative to a work station transversely extending across said web path at a preset location therealong.

In another aspect, the present invention provides contoured electrifier apparatus suitable for the processing of contour sheared pile fabrics.

In another aspect, the present invention provides a control system of the type above indicated but which is adapted for use with a train of contour shearing devices such as a mixture of contour shearing units and contoured electrifier units.

In another aspect, the present invention provides processes for using apparatus as indicated above.

Other and further objects, purposes, advantages, aims, utilities, features and the like will be apparent to those skilled in the art from a reading of the present specification taken together with the drawings.

DETAILED DESCRIPTION

Control System

Figure 1:
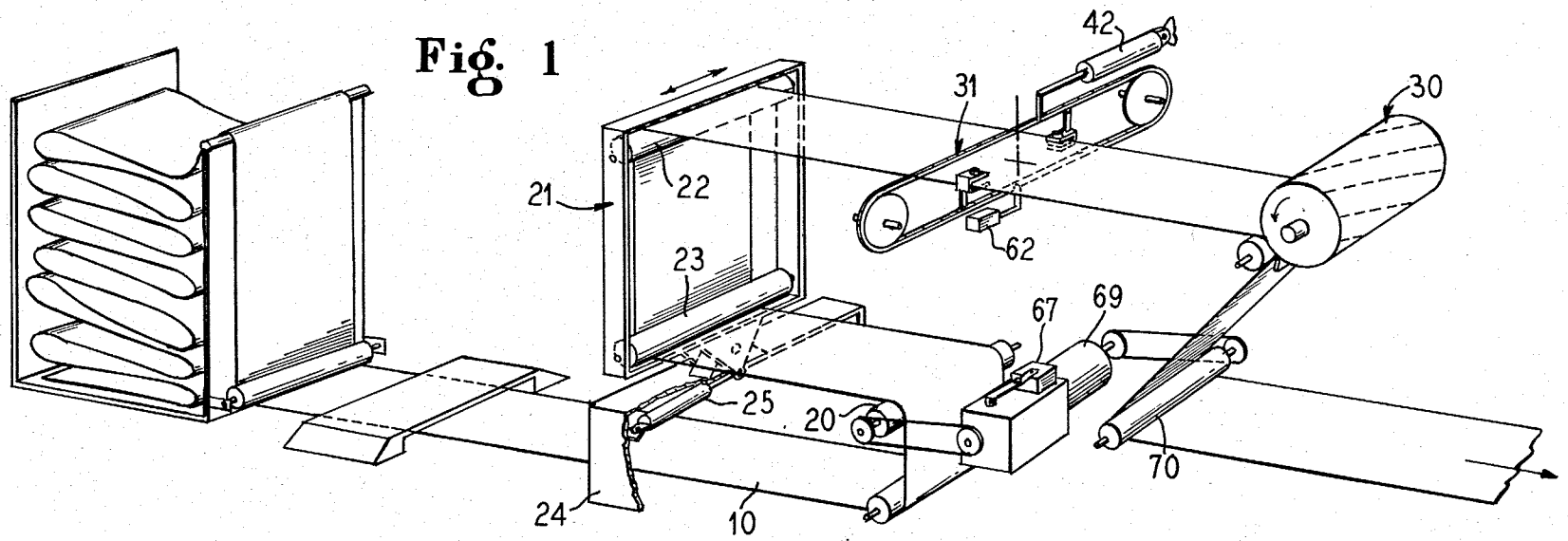
FIG. 1 is a perspective view of one embodiment of a control system of the present invention for transversely aligning and longitudinally tensioning a continuous web relative to a transversely extending work station.

A web, such as a sliver knit high pile fur-type fabric is typically continuously moved from a plaited storage bin or any other suitable source through a processing apparatus, wherein a contour shearing means contours the web as it passes through the apparatus in the direction of movement generally indicated by the arrow marked on the web in FIG. 1. For present purposes, the contour shearing means can be considered to be similar to that disclosed and claimed in the above identified copending Norman C. Abler U.S. patent application Ser. No. 719,017, filed Aug. 30, 1976, now U.S. Pat. No. 4,102,023.

The web is pulled from the storage bin by a driving roller 20 and is then moved through a steering frame assembly 21. Steering frame assembly 21 includes a pair of training rollers 22 and 23 providing together a vertical run for the web 10. The steering frame 21 is pivotally mounted on a main frame 24 (shown fragmentarily) so that the frame 21 may be rotated about the pivot on an axis which is approximately tangent to the back edge of the roller 23. This pivoting is accomplished by a fluid cylinder 25 attached to a tongue which extends rearwardly of the pivot axis and the frame 21, underneath the web 10. The resultant skewing of the roller 23 (and roller 22) provides a steering influence upon the web 10 so that the web 10 is controllably moved transversely to a predetermined and controllable lateral position during continuous movements longitudinally of the web 10. Between the steering frame 21 (and roller 22 thereof) and the contour shearing cutter 30 is positioned a control system herein designated in its entirety by the numeral 31.

Figure 3:
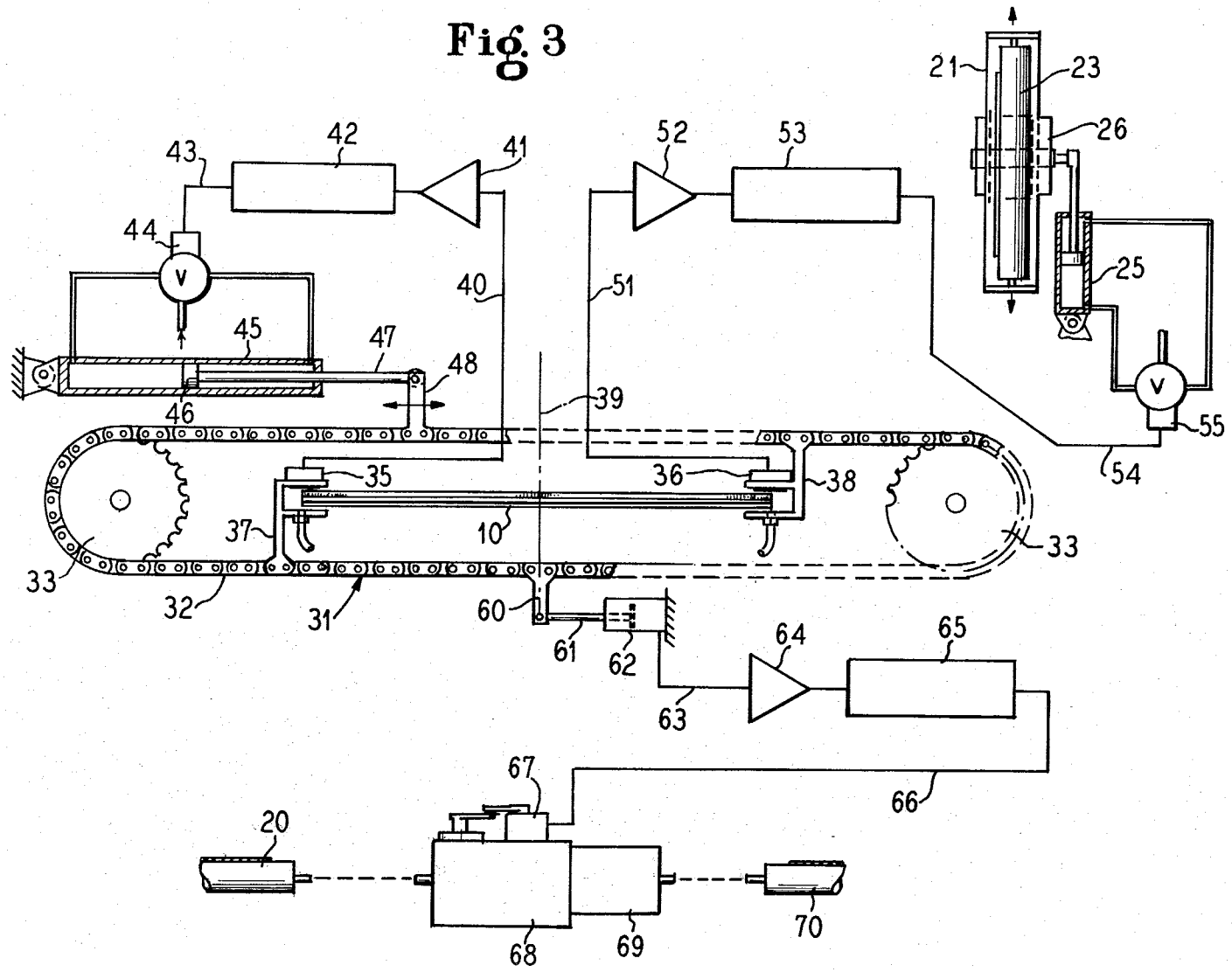
FIG. 3 is a schematic transverse sectional view taken in the region of the control elements utilized in the control system of FIG. 1.

This control system 31, see, for example, FIG. 3, functions to sense at any given instant in time the spatial position of the edges of web 10 and to convert the position of the web edges into signals which are used to control transverse position of the web as well as the transverse width of the web all relative to predetermined standards suitable for operation of the contour shearing head 30. Surrounding the web 10 is a control chain 32 which is continuous and which is extended about a pair of sprockets 33 for orbital movements about the web 10. Each opposed edge of web 10 is provided with an edge sensor mechanism designated in its entirety by the numeral 35 and 36, respectively. These sensors 35 and 36 can be of any conventional construction. In the embodiment shown, a pneumatic pressure sensor is utilized. Sensor 35 is associated with an arm 37 which is connected to the bottom portion of the chain 32, and sensor 36 is connected to an arm 38 which, in turn, is connected to the upper portion of the chain 32. As will now be explained, during operation of the entire apparatus, the sensors 35 and 36 together with sensor 62 operate to maintain an equal spacing from opposed side edges of web 10, with the web 10 being centered on center line 39. Each of the sensors 35 and 36 generates an output signal which is utilized to maintain its respective sensor in a predetermined position relative to the adjacent opposed side edge of web 10, as shown in FIG. 3.

The signal generated by sensor 35 is fed by a line 40 to an (optional) amplifier 41 and then to a controller 42. Controller 42 compares the input signal from amplifier 41 to a set point signal and generates a difference signal which is discharged from controller 42 through a line 43 to a servo-valve unit 44. Accordingly, there are two or three possibilities for operation of servo-valve 44. By one possibility (optional) the signal fed thereto produces no change (no operation) of valve 44. In a second mode, the signal 43 fed to servo valve 44 causes the valve 44 to admit fluid to double acting control cylinder 45 whereby the piston 46 thereof moves to the right, thereby moving the rod 47 to the right. Rod 47 is terminally connected to an arm 48 which is rigidly connected to the chain 32; hence, the upper rim of chain 32 is thus moved to the right. By the third possibility, the signal fed to valve 44 by the line 43 causes the piston 46 to move to the left, and, by a similar sequence of steps, the chain 32 is moved to the left. Moving the chain 32 to the right causes the sensor 35 to move away from the associated edge of web 10, and, conversely, moving the chain 32 to the left causes the sensor 35 to move towards the associated edge of web 10. When sensor 35 is so caused to move, sensor 36 will also be caused to move in corresponding relationship with respect to web 10. As can be seen by those skilled in the art, any equipment means, such as pulleys and cable, or the like, can be used to cause the sensors 35 and 36 to so move in corresponding relationship to each other.

Similarly, the sensor 36 has its output signal fed via a line 51 to an (optional) amplifier 52, and hence to a controller 53 wherein the signal is compared to a set point signal, and a difference signal is discharged from controller 53 through a line 54 to a servo control valve 55 which, like the servo control valve 44, has two or three conditions of analogous operation. The servo control valve 55 operates a double acting control cylinder 25, as indicated above, to control the skewing movements of the web frame 21, as described above.

The coaction between the two sensors 35 and 36 is effective to maintain the web 10 centered on center line 39, and, accordingly, on the center of the contour shearing knife 30. Thus, the web 10 is always maintained centered on the cutter 30.

Figure 2:
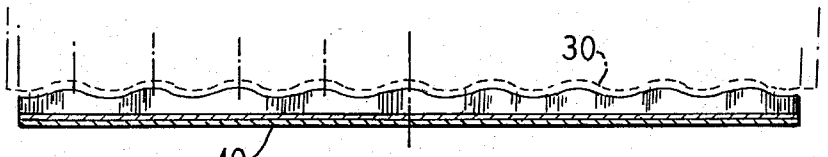
FIG. 2 is a transverse sectional view through a web member which has been processed through a contour shearing apparatus operated with the control system illustrated in FIG. 1.

The web 10, though partially dimensionally stabilized, is such that tensioning the web 10 in a longitudinal direction reduces the width thereof to a predeterminable and predictable extent. Initially, the web 10, in its relaxed state, is equal to or greater than a predetermined effective width associated with the cutter 30. During continuous operation of the apparatus shown, for example, in FIG. 2, variations in machine operation, and in web construction, can occur so that a single setting with respect to longitudinal tension on the web 10 is generally insufficient to maintain exact desired registration between the cutter 30 and the web 10. Therefore, by the present invention, there is provided a variable tensioning means which enables the web 10 to be fed continuously through the cutter 30 at a constant transverse width in the vicinity of the cutter 30, as will now be described.

For purposes of achieving automatic tensioning by the present invention, an arm 60 is secured to chain 32. Arm 60 can be at any convenient position along the chain 32, but is here shown on the bottom side of the chain 32 at about the center line 39, for convenience. Not until the sensors 35 and 36 have moved to a predetermined location relative to opposed sides of web 10 with the web 10 being tensioned to produce a predetermined desired width thereof will the arm 60 itself be in a predetermined centered position. When the arm 60 is in its own centered position, which here happens to coincide with center line 39, and the arm 60 is connected to a sensor 62 by a connecting rod 61, the sensor 62 being conveniently a potentiometer or a linearly variable differential transformer or LVDT, a signal is generated by the sensing device 62 which is charged to a line 63. Line 63, in turn, connects with an amplifier 64, (optional) and the signal from amplifier 64 is fed directly to a controller 65. In the controller 65, the signal charged thereto is compared to a set point signal, and an output signal is generated which is charged to another line 66 which feeds the output signal to a servo motor 67. The servo motor 67 adjusts the output speed of a variable speed drive such as a variable diameter pulley or the like 68 which is drivably connected to the drive roller 20. In turn, the variable speed drive 68 is driven by a gear head motor 69. The gear head motor 69 is coupled to a down stream drive roller 70 which is beyond the cutter 30. Thus, the web 10 is maintained at the required tension between the respective rollers 70 and 20 whereby the tensioning on the web 10 in a longitudinal direction is such that at any given instant in time the transverse width of the web 10 has the desired predetermined constant width in the vicinity of the cutter 30. Obviously, by driving the roller 20 at a slightly reduced speed relative to some constant value or to the roll speed of the roller 70, the tension on the web 10 can be increased slightly, and vise versa. Thus, with the roller 20 moving at a decreased speed relative to roller 70, tensioning of the web 10 longitudinally is increased between these rollers. Conversely, if the speed of the roller 20 is increased slightly so that it comes closer to the speed of the roller 70, then tension longitudinally on the web 10 is decreased. Whenever the arm 60 is not on center because of the width of the web being larger or smaller than some predetermined value, the sensor 62 is generating an output signal which is representative of the deviation from center.

Through this arrangement the web width is adapted to be controlled without lateral mechanical restraint of the web, that is, without using any means, such as grippers, rollers or the like, for engaging the web edges for this purpose.

Obviously, the roller 70 must be driven at a greater speed than the roller 20 to maintain a tension longitudinally along the web 10. If the converse were true, then a surplus of webbing would be built up between the rollers 20 and 70, and tension would be lost altogether.

Figure 4:
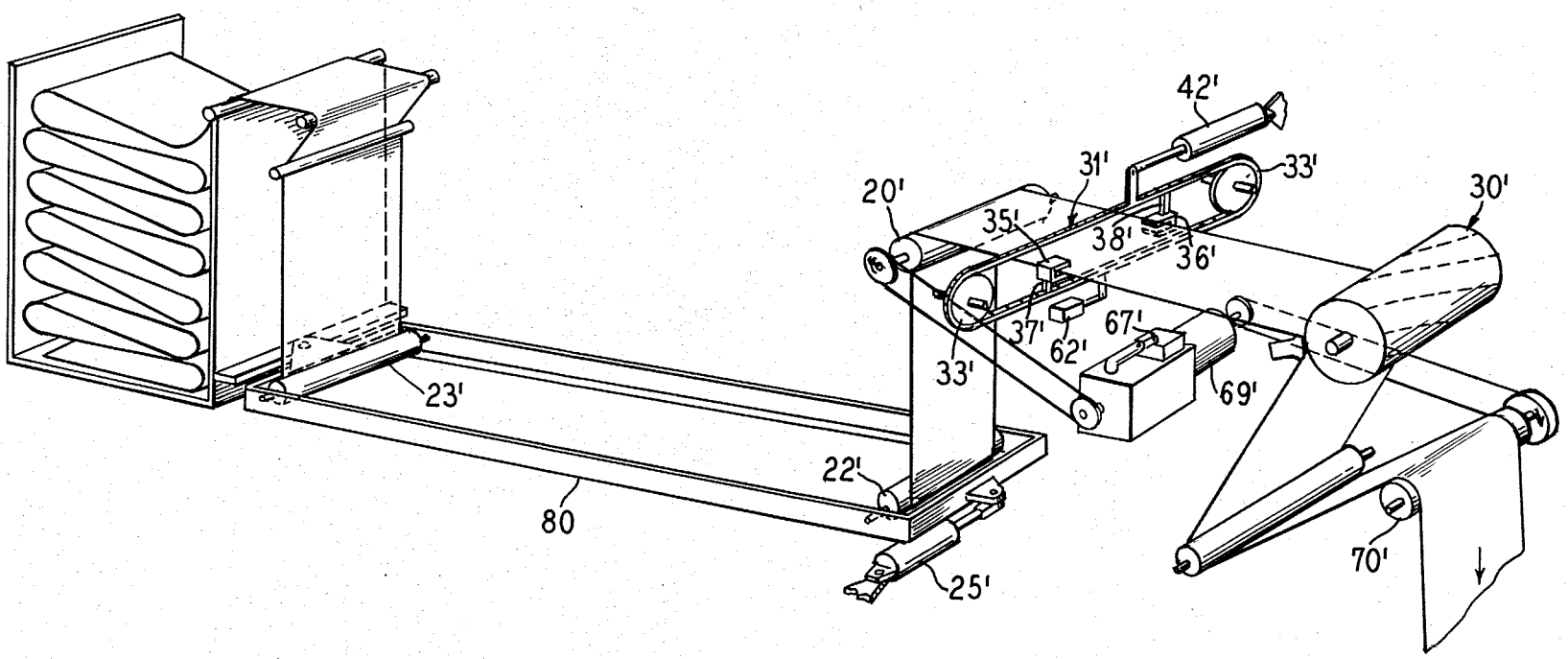
FIG. 4 is a view similar to FIG. 1 but showing an alternative embodiment of the control system of the present invention.
Figure 5:
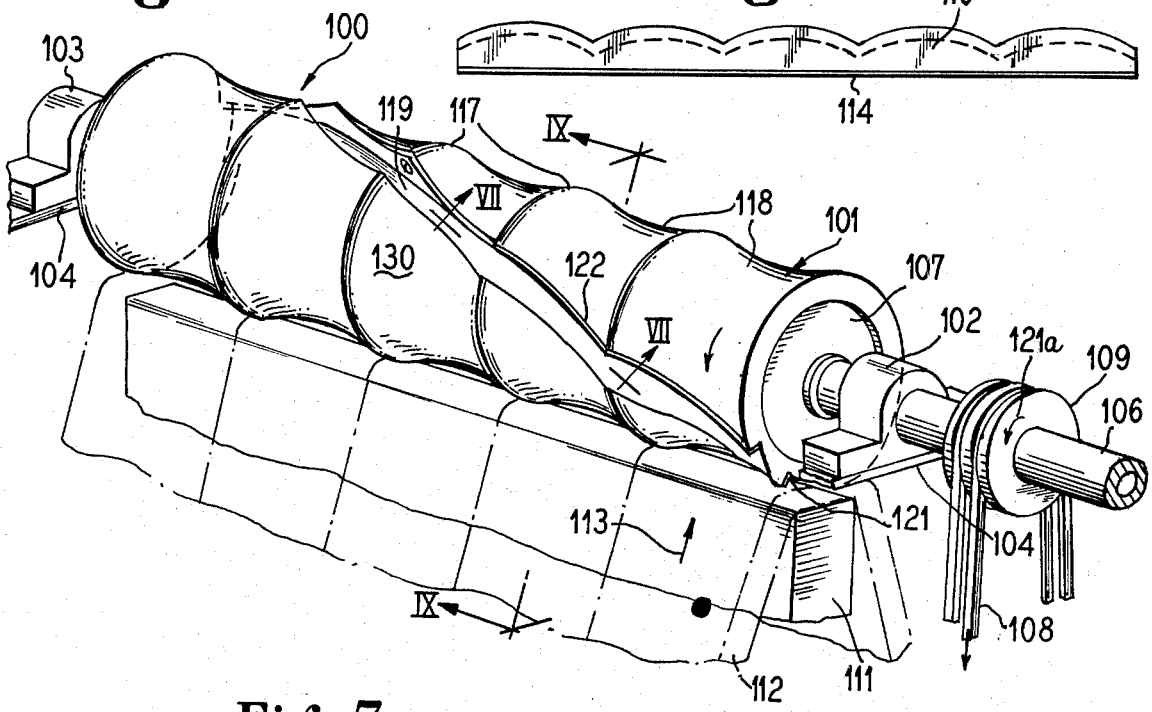
FIG. 5 is a perspective view of one embodiment of a contour electrifier of the present invention.

Referring to FIG. 4, there is seen another embodiment of a control system of the present invention which is similar to the embodiment shown in FIGS. 1 and 3 except that here a steering frame assembly 80 is oriented generally in a horizontal plane rather than the orientation in a generally vertical plane in the manner of the steering frame assembly 21, and it is shown located prior to the variable speed tension roller 20' rather than between the two tensioning rollers 20' and 70'.

In the embodiments of FIGS. 1 and 3 and the embodiment of FIG. 4, as those skilled in the art will appreciate, in place of the contour shearing means illustratively shown one can employ a contoured electrifier means such as one of the character herein described.

Contoured Electrifier with Flat Rest

Referring to FIGS. 5 and 7 through 10 there is seen one embodiment of an electrifier apparatus 100 of the present invention which is provided with a contoured electrifier roll. The apparatus employs an electrifier roll or cylinder 101 rotatably mounted in suitable pillow blocks 102 and 103 carried by a frame 104 (not detailed). A conventional motor (not shown) drives a tubular stub shaft 106 which is axially connected with the cylinder 101 by end plates (paired) 107 through V-belt 108 rotatably turning sheaves 109 keyed to shift 106. Operating speeds for the cylinder 101 can vary but normally fall in the range of from about 700 to 1400 rpm.

Cylinder 101 is suitably controllably heated internally by means of an electrical heating system such as the electrical heating system taught by Henry Martin in U.S. Pat. No. 3,641,635. Alternatively, a gas heating system can be used.

Extending longitudinally in axially spaced relationship to cylinder 101 is a work support bar or rest 111 which is suitably supported by frame members (not detailed). Work is illustratively being performed by the electrifier of this embodiment here on contour sheared high pile, sliver knit fabric 112 which is continuously moved in the direction shown by arrow 113 over a nip region 115 between circumferential surface portions 130 of cylinder 101 and bar 111. The width of the web of fabric 112 can vary widely, but illustratively and commonly falls in the range of from about 48 to 84 inches, depending upon the type of knitting equipment being used.

Figure 6:
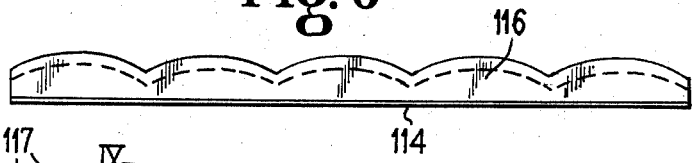
FIG. 6 is an enlarged fragmentary detail view transversely taken across a portion of a web member which has been initially contour sheared and then processed through a contoured electrifier of the type shown in FIG. 5.
Figure 7:
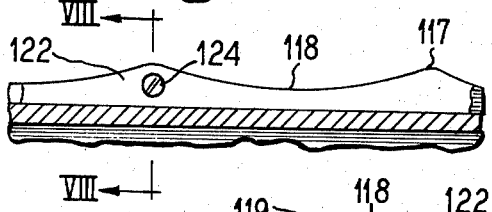
FIG. 7 is an enlarged detail fragmentary view taken in the region VII—VII of FIG. 5.
Figure 10:
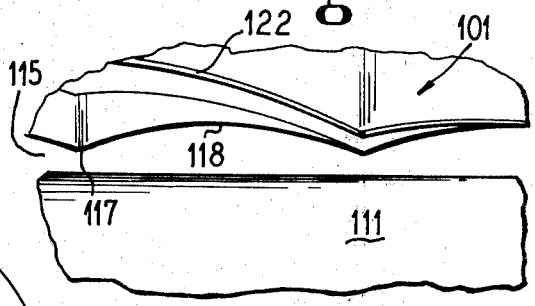
FIG. 10 is a fragmentary elevational view taken along the line X—X of FIG. 9.
Figure 9:
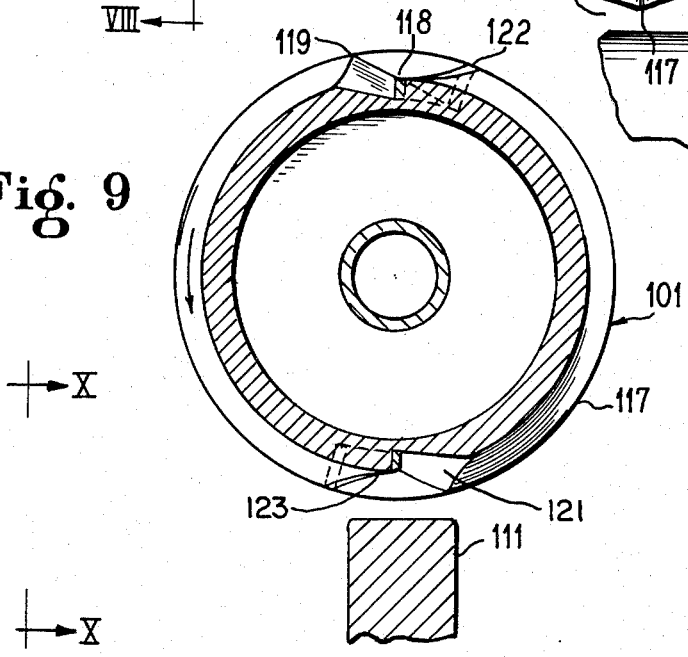
FIG. 9 is a transverse sectional view taken through the region IX—IX of FIG. 5 illustrating construction of the contoured electrifier roll.

Referring to FIG. 6, and as those skilled in the art will appreciate, the fabric 112 has a base 114 of woven or knitted material and a pile 116 of natural or synthetic fibers which are joined to the base 114. Here, the pile 116 has previously been subjected to a contour shearing operation using, preferably, a contour shearing device for pile fabrics, such as shown and described in my above referenced Abler U.S. patent application Ser. No. 719,017, filed Aug. 30, 1976. As those skilled in the art will appreciate, the electrifier 100 can also be used to work upon many types of natural or synthetic fabrics, furs, and other webs of material, if desired.

The fabric 112 is advanced by a conventional work feeding mechanism (not detailed) through the electrifier 100 with the pile 116 moving against the circumferential surface 130 of cylinder 101. The work feeding mechanism can be the same as previously described here-in for feeding work through the contour shear.

Preferably, the electrifier 100 is operated in cooperation with a control system, such as one provided by the present invention, so as to provide for automatically regulating transverse variations in web width, alignment, and registration of the fabric 112 with the cylinder 101 and its contours.

Cylinder 101 is commonly hollow and has a longitudinal length which is determined by the maximum width of the fabric being processed in any given instance, the capacity of the equipment, and the like. The outside diameter of the cylinder 101 can range typically from around 8 to 24 inches with about 12 inches being a particularly preferred and useful distance for peak diameters. The thickness of the wall of cylinder 101 can vary, but typically is in the range of from about $\frac{5}{8}$ to $1\frac{1}{2}$ inches. The cylinder 101 is conveniently formable by casting a metal, such as steel, or the like, followed by machining operations to complete circumferential surface contours to desired specifications. The circumferential surface portions of the cylinder 101 are formed so as to comprise a plurality of longitudinally spaced, circumferentially extending, radially projecting ridged portions 117. Between adjacent pairs of ridge peaks 117, the cross sectional diameters of the cylinder 101 progressively decline to minimal cylinder diameters, as is illustrated, for example, in the regions 118 of the cylinder 101. The configuration of the peaks 117, and of the valleys 118, can, of course, vary from one cylinder to another, depending upon the wishes of the user, the type of contour sheared fabric being worked, desired operating parameters, and the like.

Formed in exterior circumferential surfaces of the cylinder 101 are helically arranged, longitudinally extending grooves 119 and 121. The direction of rotation of cylinder 101 is illustrated by arrow 121*a* which establishes the groove 119 as being a right-hand groove in terms of the direction in which loose fibers, moisture, or the like, will be laterally moved by the species of "combing" action of this groove upon the fabric 112 during operation of the electrifier 100. Groove 121 is a left-hand groove since it "works" the surface of fabric 112 toward the left during operation of electrifier 100.

The surface material of the cylinder 101 is cut away to form the grooves 119 and 121. The contour of a groove 119 or 121 may vary widely but in a preferred form is illustrated, for example, in FIGS. 7, 9 and 10. The "trailing" wall of each groove 119 and 121 is abruptly radially shouldered throughout substantially the entire respective lengths of such grooves, and a metal wear blade 122 and 123, respectively, is mounted securely against such shoulder by means of screws 124. The exposed corner of each blade 122 and 123 is preferably rounded slightly, as shown at R in FIG. 8, since such a corner provides a region of abrasion against the treated work piece (here fabric 112) and it is desired to avoid severe scraping or tearing action upon a work piece.

Figure 8:
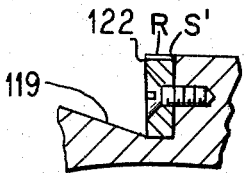
FIG. 8 is an enlarged detailed fragmentary view taken along the line VIII—VIII of FIG. 7.

The exposed, substantially radially oriented surface of each blade is desirably subtly serrated, as represented at S in FIG. 8, to impart a mild combing action upon the pile.

Electrifier with Contoured Rest

Figure 11:
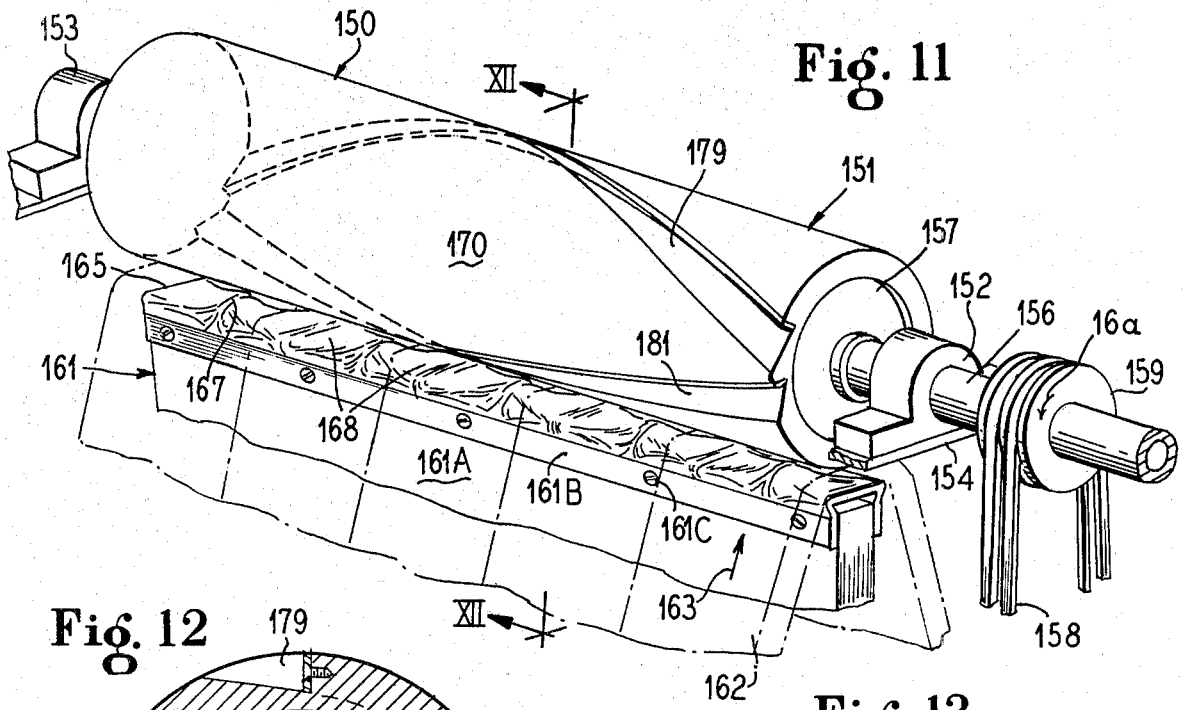
FIG. 11 is a view similar to FIG. 5 but showing an alternative embodiment of a contoured electrifier of the present invention.
Figure 12:
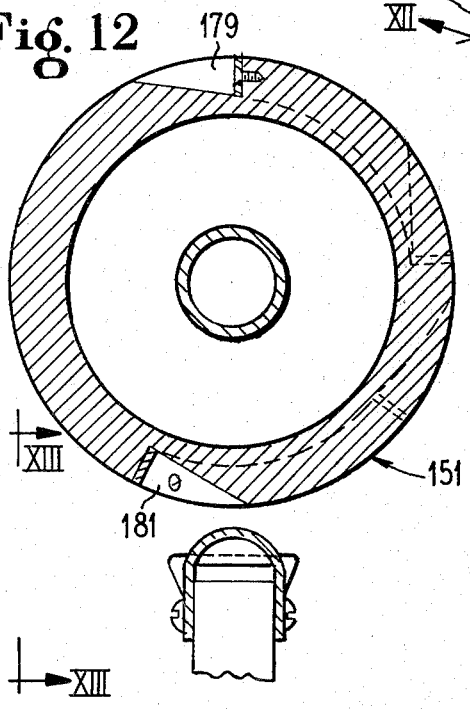
FIG. 12 is a view similar to FIG. 9 but taken along the line XII—XII of FIG. 11.
Figure 13:
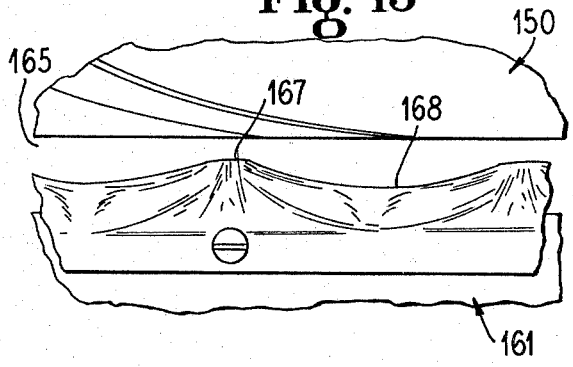
FIG. 13 is a view similar to FIG. 10 but taken along the line XIII—XIII of FIG. 12.

Referring to FIGS. 11–13, there is seen one embodiment of an electrifier apparatus 150 of the present invention which is provided with a contoured rest and a cross sectionally uniform (except for groove position) electrifier roll. The apparatus employs an electrifier roll or cylinder 151 rotatably mounted in suitable pillow blocks 152 and 153 carried by a frame 154 (not detailed). A conventional motor (not shown) drives a stub shaft 156 which is axially connected with the cylinder 151 by end plates (paired) 157 through V-belts 158 rotatably turning shieves 159 keyed to shaft 156. Operating speeds for the cylinder 151 can vary but normally fall in the range of from about 700 to 1400 rpm.

Cylinder 151 is suitably controllably heated internally similarly to cylinder 101.

Extending longitudinally in axially spaced relationship to cylinder 151 is a work support bar or rest 161 which is suitably supported by frame members (not detailed). Bar 161 is here comprised of a base support 161A over the head portion of which is mounted a cap plate 161B which is secured to support 161A by means of screws 161C. Work is illustratively being performed by the electrifier of this embodiment here on a longitudinally contour sheared high pile sliver knit fabric 161 which is continuously moved in the direction shown by arrow 163 over a nip region 165 between circumferential surface portions 170 of cylinder 151 and bar 161. The width of the web of fabric 162 can here likewise vary widely, but illustratively and commonly falls in the range of from about 48 to 84 inches, depending upon the type of knitting equipment being used. The fabric 162 can be considered for illustrative purposes here to be similar to fabric 112 above described.

As those skilled in the art will appreciate, the electrifier 150 can also be used to work upon many types of natural or synthetic fabrics, furs, and other webs of material, if desired.

The fabric 162 is advanced by a conventional work feeding mechanism (not detailed) through the electrifier 150 with its pile moving against the circumferential surface portions 170 of cylinder 151.

Preferably, the electrifier 150 is operated in cooperation with a control system, such as one provided by the present invention, so as to provide for automatically regulating transverse variations in web width, alignment, and registration of the fabric 112 with the cylinder 151 and its contours.

Cylinder 151 is commonly hollow, has a constant outside diameter, and has a longitudinal length which is variable and dependent upon such variables as the type of fabric being processed in any given instance, the capacity of the equipment, and the like. The outside diameter of the cylinder 151 can range typically from around 8 to 24 inches with about 12 inches being a particularly preferred and useful distance for peak diameters. The thickness of the wall of cylinder 151, if hollow can vary, but typically is in the range of from about $\frac{5}{8}$ to $1\frac{1}{2}$ inches. The cylinder 151 is conveniently formable by casting a metal, such as steel, or the like, followed by machining operations to complete circumferential surface contours to desired specifications, the range of from about $\frac{5}{8}$ to $1\frac{1}{2}$ inches. The cylinder 151 is conveniently formable by casting a metal, such as steel or the like followed by machining operations.

Formed in exterior circumferential surfaces of the cylinder 151 are helically arranged grooves 179 and 181. The direction of rotation of cylinder 151 is illustrated by arrow 169 which establishes the groove 179 as being right-hand groove in terms of the direction in which loose fibers, moisture, or the like will be laterally moved by the "combing" action of this groove upon the fabric 162 during operation of the electrifier 150. Similarly groove 161 is a left-hand groove since it "works" the surface of a treated fabric 112 toward the left.

The surface material of the cylinder is cut away to form the grooves 179 and 181 and the contour of a groove is illustrated, for example, in FIGS. 12 and 13. Groove characteristics here are similar to those for grooves 119 and 121.

In general, a larger diameter cylinder can have more grooves and therefore provide more polishing action per work station.

The surface portions of the cap plate 161B are formed so as to comprise a plurality of longitudinally spaced, circumferentially extending peaked ridged portions 167. Between adjacent pairs of peaks 167, the distance of the cap plate 161B progressively increases relative to the axis 168 of cylinder 151 to maximum distances as is illustrated, for example, in the regions 156 of the cap plate 161B. The configuration of the peaks 167 and the valleys 168 can, of course, vary from rest to rest depending upon such factors as the wishes of the user, the type of contour sheared fabric being worked, and the like.

A contour electrifier rest 161 is adaptable for use in a plane electrifier machine to process a three dimensional deep-pile contoured fabric wherein the effect achieved simulates a sewing together of small animal pelts, such as mink. The electrifier rest 161 has a contour surface in cap piece 161B made up of elements forming a mirror image of a contour in such a starting fabric for electification. The contour surface is formed so that the length of the travel path of contoured fabric drawn across its face is uniform. Tension applied to contoured fabric drawn across the various surfaces of rest 161 is therefore uniform and fabric distortion is substantially eliminated. Subsequently, as the contoured fabric is electrified it is provided with desired natural-looking contours. The contour surfaces are designed such that the fabric when passing over them traverses the same distance over all surfaces and is subjected to substantially the same amount of tension throughout to eliminate fabric distortion. The electrifier rest is preferably formed from a metal blank which is bent into a U-shape. In a particular embodiment, the apex of the bent blank is deformed to provide a first contour representing high points of the electrifier rest and the sides of the bent blank are deformed to protrude laterally in areas adjacent the low points of the apex contour. The deformation of the bent blank has the effect of providing fabric paths on the electrifier rest which are substantially of the same length over all regions thereof.

Figure 17:
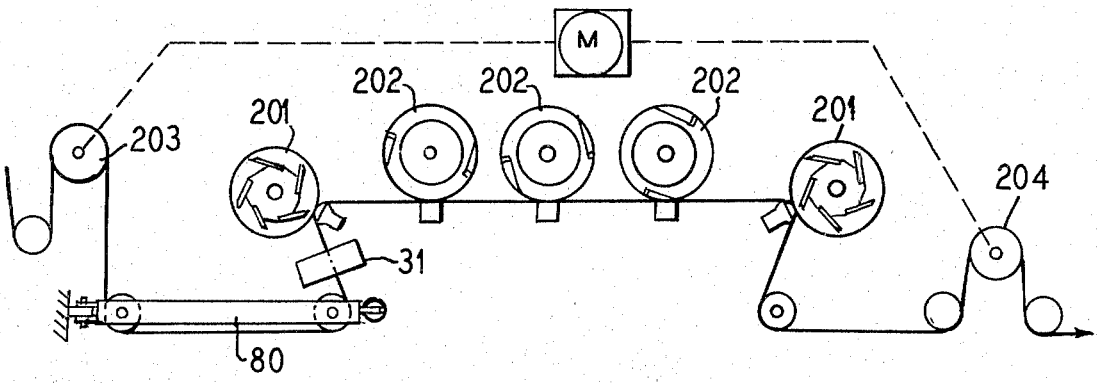
FIG. 17 is a view similar to FIG. 14 but illustrating the manner in which a control system of the present invention may be used to control five contour processing units simultaneously with such units being sequentially arranged relative to one another along a web pathway.
Figure 14:
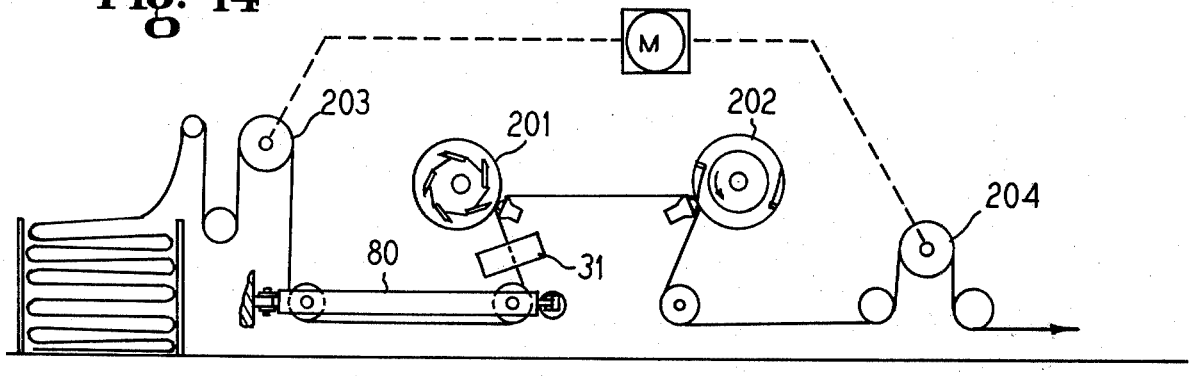
FIG. 14 illustrates an embodiment of the present invention wherein a control system as provided herein is used to control the web path through and past two sequentially arranged contour processing units, the processing units being a contour shearing device and a contour electrifier device respectively.

It will also be recognized that all the repetitive contours in an electrifier rest could be formed on a single continuous sheet, as shown in FIG. 17 of my aforementioned U.S. patent application. As the fabric is drawn across the rest it may be electrified precisely by cylinder action. See also FIG. 9 and the accompanying text of such application. In general, the web-path length in all regions of an electrifier rest is substantially equal in all regions of the electrifier rest regardless of its contour shape.

In contoured electrifier assemblies, the space between the periphery of the electrifier cylinder and the fabric rest is varied in a repeatable manner to conform substantially to variations in pile height of fabric to be processed therein. Because of less stringent mechanical restrictions, acheivement of variations in this space is not limited to geometric variations in the fabric rest as is the case with contour shears as described in my copending application above cited. Therefore, by the practice of the present invention, such variations in distance between cylinder circumferential portions and radially adjacent rest surface portions are achievable by either radially circumferentially contouring the electrifier cylinder or by incorporating into the electrifier rest surface contour profiles.

A contour electrifier of this invention includes web guide means for passing a web member between the rotatable heatable electrifier cylinder and the electrifier rest member such that such web member transversely is in predetermined registration with spacings radially existing between said cylinder and said rest member. Typically the web guide means includes web width control means.

Referring to FIGS. 14 through 17, various embodiments of systems are shown which each incorporate a modified control system of the present invention in combination with at least two contour processing units for controlling web travel along a path to, through and past each contour processing unit in the plurality of units incorporated into each respective system. Each processing unit may be either a contour shearing device or a contour electrifier device.

The structure of the control system utilized in each of the embodiments of FIGS. 14 through 17 involves a control system 31 in combination with a steering frame assembly 80. Thus, each control system is similar to the embodiment shown in FIG. 4 except that the web path is expanded and extended to permit location therealong of more than one contour processing unit.

Figure 15:
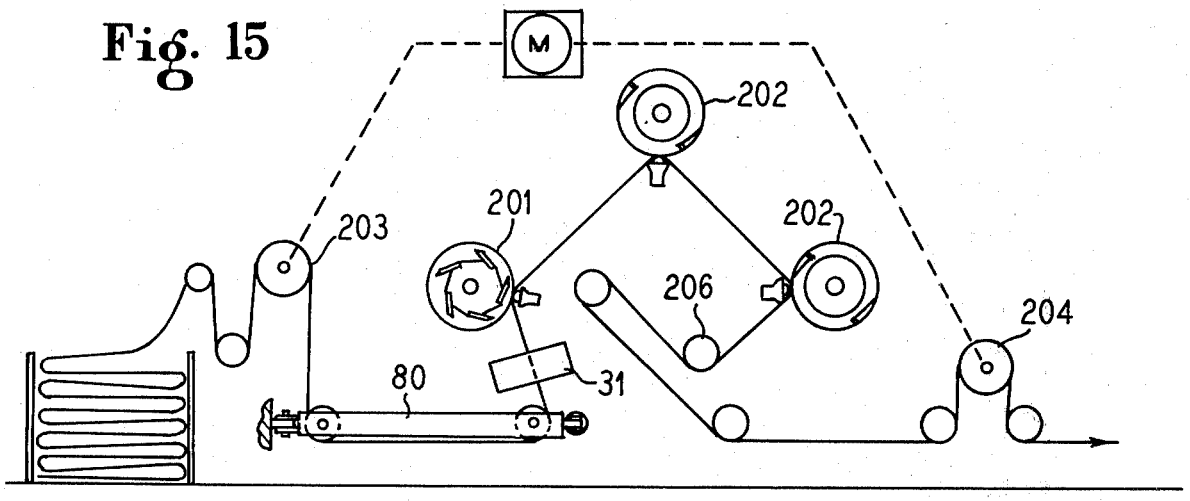
FIG. 15 is a view similar to FIG. 14 but showing such control apparatus being employed to regulate the web path past and through each of three contour processing units.

In each of FIGS. 14 through 17, the processing units are either a contour shearing device or a contour electrifier device. Anyone skilled in the art will recognize that in place of contour shears or electrifiers, any other transverse operation may be employed. Each of the contour shearing devices is designated by the numeral 201 while each of the contour electrifier devices is designated by the numeral 202, for convenience. Similarly, in each of FIGS. 14 through 17, the pair of drive rollers incorporated into the control system is designated by the numbers 203 and 204 which are differentially driven with respect to one another in a manner similar to that above described in reference to the embodiment of FIGS. 1 and 3. In FIG. 15, roller 206 can alternately be used as a drive roll in place of 204.

Figure 16:
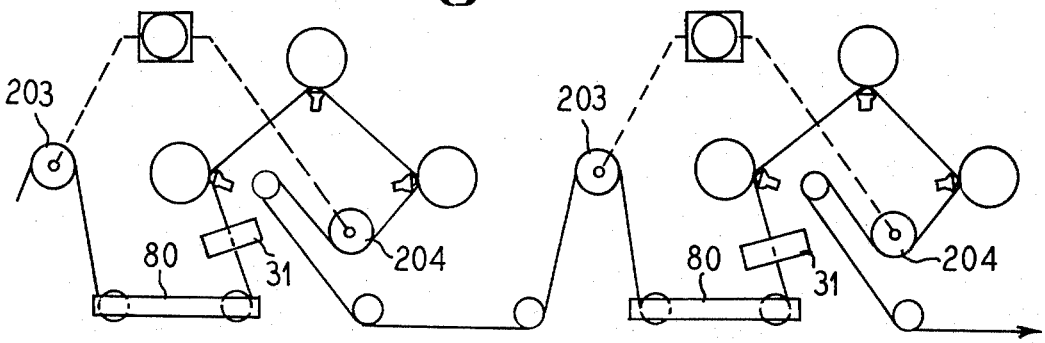
FIG. 16 is a view similar to FIG. 14 but illustrating the utilization of two control units of the present invention in a sequential arrangement relative to one another, each control unit being employed to regulate the operation of three contour processing units in the manner as shown, for example, in FIG. 15.

In FIG. 17, arrangements of some processing units are illustrated which are so arranged relative to one another that the path of web travel from one such unit to the next thereof sequentially is generally flattened or straight. In the embodiments shown in FIGS. 14, 15 and 16, the respective processing units are arcuately arranged spatially relative to one another so that a series of bends or variations in web path occur with one path change occurring substantially at each such processing unit. Typically, the web path can be straight through an electrifier having a contoured cylinder and straight fabric rest. When a contoured rest is employed, however, the web must wrap or bend around the rest to some extent. As illustrated in FIG. 16, two or more successive such systems can be placed into a sequential arrangement relative to one another with respect to a path of web travel.

I claim:

1. Control system for web alignment, registration, and longitudinal tensioning along a web path generally aligned relative to a work station which transversely extends across said web path at a preset location therealong, said control system comprising:

(a) a pair of driving roller means, each one located transversely across said web path, one located upstream, the other located downstream, respectively, from said work station, for translating such a web along said web path and also for maintaining a desired longitudinal tension of such a web between respective ones of said pair of driving roller means, (b) first drive means for driving each of said driving roller means including selectively variable rotational speed control means for differentially rotatably driving one of said driving roller means of said pair at a different surface speed with respect to the other thereof, (c) a steering frame assembly, including two guide roller means located transversely across said web path upstream from said work station with respect to the direction of web movement along said web path, said steering frame assembly having a pivot axis located centrally relative to said web path and perpendicularly relative to said steering frame assembly for reciprocal arcuate movements of said guide roller means transversely across said web path, (d) second drive means for reciprocally pivoting said steering frame assembly, (e) a first and a second position sensing means, located in opposed relationship to one another at opposed sides of said web at a preset longitudinal location therealong, each of said sensing means being movable transversely such that a movement of one toward or away from the other is accompanied by a corresponding movement in the other and each one of said position sensing means being able to instantaneously sense the spatial position of its related one side edge of said web relative to said one sensor and to generate a position signal representative of such transverse web edge position so sensed, (f) alignment control means responsive to signal from said first position sensing means and suitable for actuating said second drive means for causing said steering assembly to transversely position said web continuously, (g) reversible drive means responsive to signal from said second position sensing means for causing said pair of position sensing means to follow transverse width changes in said web and also to follow movements of said web produced by said steering frame assembly, (h) a third position sensing means cooperating with said first and second sensing means for instantaneously sensing position changes in said first and second sensing means and for generating a third signal representative of the transverse width of said web, and (i) width control means for comparing said third signal to a constant factor representative of a predetermined width desired for said web and for generating a difference signal representative of any differences sensed, said difference signal being operative for controlling said first drive means for variably and differentially rotatably driving one of said driving roller means with respect to said other driving roller means for thereby causing variations in longitudinal tensioning of the web sufficient to maintain continuously said desired web width.

2. A control system according to claim 1, in combination with the work station and wherein said work station has a contour shearing device extending across the width of the web for contour shearing high pile on the web.

3. A control system according to claim 1, in combination with the work station and wherein said work station has a rotary electrifier which systematically varies in cross-sectional diameter within a predetermined range and adapted for acting on high pile on said web.

4. A control system according to claim 1, in combination with the work station, and wherein said work station comprises a contour shearing device and a contour electrifier device operatively located to act sequentially on deep pile on the width controlled web.

5. A control system according to claim 1 in combination with the work station, and wherein the work station has a pair of contour shear devices substantially spaced along the path of the web and a plurality of contour electrifier devices operatively located between said contour shear devices, and all of said devices being operative to act on deep pile on said web which is maintained continuously at said desired web width.

6. A control system according to claim 1, wherein said reversible drive means comprises an endless chain extending in clearance relation about said web path and carrying said pair of position sensing means, means reversably mounting said chain, and means connected to said chain for effecting movements of the chain responsive to signal from said second position sensing means.

7. A control system according to claim 6, wherein said movement effecting means comprises control means including a signal operating actuator for motivating the movement effecting means.

8. A control system according to claim 6, wherein one of said pair of position sensing means is carried by a part of the chain extending transversely in spaced relation opposite one face of the web and the other of said pair of position sensing means is carried by a part of said chain extending in spaced relation transversely relative to the opposite face of said web.

9. A control system according to claim 6, wherein said third position sensing means comprises a device having a control member attached to said chain.

10. A control system according to claim 9, wherein said member comprises a connecting rod, and an arm fixed to said chain and connected to said connecting rod.

11. A control system according to claim 1, including an endless chain, means mounting said endless chain operatively relative to the web path, means mounting said first and second position sensing means on said chain, and means carried by said chain for operating said thrid position sensing means.

12. A control system according to claim 1, wherein said steering frame assembly extends in a substantially horizontal direction, and said two guide roller means are located in horizontally spaced relation to one another on said frame.

13. A control system according to claim 1, wherein said steering frame assembly is disposed substantially vertically, and said two guide roller means are located on the steering frame assembly in vertically spaced relation to one another.

14. A control system according to claim 1, wherein said second drive means for reciprocally pivoting said steering frame assembly comprises a fluid cylinder device operated by said alignment control means.

15. In combination, a contour electrifier and a control system for web alignment, registration and longitudinal tensioning along a web path generally centered relative to a work station in which said contour electrifier is operative and extends transversely across said web path at a predetermined location therealong:

said contour electrifier comprising a rotatable heatable cylinder including journal means therefor, an elongated rest member in adjacent, radially spaced, longitudinally extending relationship to said cylinder, the interrelationship between said cylinder and said rest member further being such that circumferentially outer surface portions of said cylinder vary in a longitudinally repeating manner in their radial spacings from adjacent surface portions of said rest member;

and said control system comprising a pair of driving roller means, each one located transversely across said web path, one located upstream, the other located downstream, respectively, from said work station, for translating such a web along said web path and also for maintaining a desired longitudinal tension of such a web between respective ones of said pair of driving roller means; first drive means for driving each of said driving roller means including selectively variable rotational speed control means for differentially rotatably driving one of said driving roller means of said pair at a different surface speed with respect to the other thereof; a steering frame assembly, including two guide roller means located transversely across said web path upstream from said work station with respect to the direction of web movement along said web path, said steering frame assembly having a pivot axis located centrally relative to said web path and perpendicularly relative to said steering frame assembly for reciprocal arcuate movements of said guide roller means transversely across said web path; second drive means for reciprocally pivoting said steering frame assembly; a first and a second position sensing means, located in opposed relationship to one another at opposed sides of said web at a present longitudinal location therealong, each of said sensing means being movable transversely such that a movement of one toward or away from the other is accompanied by a corresponding movement in the other and each one of said position sensing means being able to instantaneously sense the spatial position of its related one side edge of said web relative to said one sensor and to generate a position signal representative of such transverse web edge position so sensed; alignment control means responsive to signal from said first position sensing means and suitable for actuating said second drive means for causing said steering assembly to transversely position said web continuously; reversible drive means responsive to signal from said seond position sensing means to follow transverse width changes in said web and also to follow movements of said web produced by said steering frame assembly; a third position sensing means cooperating with said first and second sensing means for instantaneously sensing position changes in said first and second sensing means and for generating a third signal representative of the transverse width of said web, and width control means for comparing said third signal to a constant factor representative of a predetermined width desired for said web and for generating a difference signal representative of any differences sensed, said difference signal being operative for controlling said first drive means for variably and differentially rotatably driving one of said driving roller means with respect to said other driving roller means for thereby causing variations in longitudinal tensioning of the web sufficient to maintain continuously said desired web width;

whereby said web is substantially accurately guided through said contour electrifier in predetermined registration with said radial spacings in said contour electrifier.

16. In combination, an electrifier and a control system for web alignment, registration, and longitudinal tensioning along a web path generally centered relative to a work station in which said electrifier is operative and which extends transversely across said web path at a predetermined location therealong:

said electrifier having an outer walled hollow revolvable electrifier cylinder interiorly provided with heating means and control means for the heating means, said electrifier having an outer circumference which systematically varies in cross-sectional diameter within a predetermined range;

and said control system comprising a pair of driving roller means, each one located transversely across said web path, one located upstream, the other located downstream respectively, from said work station, for translating such a web along said web path and also for maintaining a desired longitudinal tension of such a web between respective ones of said pair of driving roller means; first drive means for driving each of said driving roller means including selectively variable rotational speed control means for differentially rotatably driving one of said driving roller means of said pair at a different surface speed with respect to the other thereof; a steering frame assembly, including two guide roller means located transversely across said web path upstream from said work station with respect to the direction of web movement along said web path, said steering frame assembly having a pivot axis located centrally relative to said web path and perpendicularly relative to said steering frame assembly for reciprocal arcuate movements of said guide roller means transversely across said web path; second drive means for reciprocally pivoting said steering frame assembly; a first and second position sensing means, located in opposed relationship to one another at opposed sides of said web at a preset longitudinal location therealong, each of said sensing means being movable transversely such that a movement of one toward or away from the other is accompanied by a corresponding movement in the other and each one of said position sensing means being able to instantaneously sense the spatial position of its related one side edge of said web relative to said one sensor and to generate a position signal representative of such transverse web edge position so sensed; alignment control means responsive to signal from said first position sensing means and suitable for actuating said second drive means for causing said steering assembly to transversely position said web continuously; reversible drive means responsive to signal from said second position sensing means for causing said pair of position sensing means to follow transverse width changes in said web and also to follow movements of said web produced by said steering frame assembly; a third position sensing means cooperating with said first and second sensing means for instantaneously sensing position changes in said first and second sensing means and for generating a third signal representative of the transverse width of said web; and width control means for comparing said third signal to a constant factor representative of a predetermined width desired for said web and for generating a difference signal representative of any differences sensed, said difference signal being operative for controlling said first drive means for variably and differentially rotatably driving one of said driving roller means with respect to said other driving roller means for thereby causing variations in longitudinal tensioning of the web sufficient to maintain continuously said desired web width.

* * * * *